United States Patent [19]

Seitz et al.

[11] Patent Number: 4,757,698

[45] Date of Patent: Jul. 19, 1988

[54] DUST EXTRACTION DEVICE FOR FLAT KNITTING MACHINES

[75] Inventors: Herbert Seitz, Nuremberg; Eugen Frosch, Hiltpoltstein; Ernst Goller, Reutlingen; Jochen Dieringer, Hechingen, all of Fed. Rep. of Germany

[73] Assignee: H. Stoll GmbH & Co., Reutlingen, Fed. Rep. of Germany

[21] Appl. No.: 82,552

[22] Filed: Aug. 7, 1987

[30] Foreign Application Priority Data

Aug. 7, 1986 [DE] Fed. Rep. of Germany ..... 3626759

[51] Int. Cl.[4] ..... D04B 35/32

[52] U.S. Cl. ..... 66/168

[58] Field of Search ..... 66/168

[56] References Cited

U.S. PATENT DOCUMENTS 4,667,489 5/1987 Seitz et al. ..... 66/168

FOREIGN PATENT DOCUMENTS 3130584 2/1983 Fed. Rep. of Germany ..... 66/168

3305795 8/1984 Fed. Rep. of Germany ..... 66/168

*Primary Examiner*—Ronald Feldbaum

*Attorney, Agent, or Firm*—Larson and Taylor

[57] ABSTRACT

The dust extraction device located on the cam carriage (13) of the flat knitting machine has separate, independently operable suction fans (27) for the front and rear needle beds (11,12), which, by lowering of the suction nozzles (29,30), the use of smooth-walled suction ducts (31,32) and coupling of the dust containers (37) with the suction ducts and with the suction fans (27) ensures a good cleaning effect with low expenditure of energy and a maintenance free operation.

9 Claims, 3 Drawing Sheets

DUST EXTRACTION DEVICE FOR FLAT KNITTING MACHINES

DESCRIPTION

Figure 1:
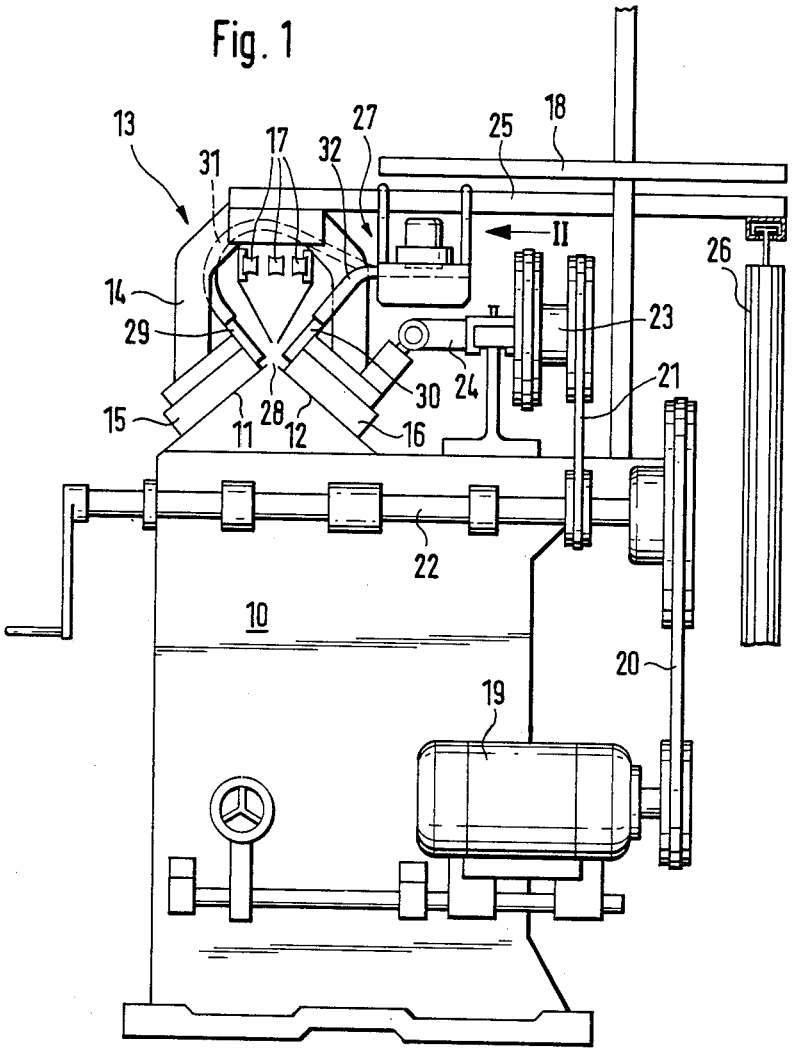

The invention relates to a dust extraction device for flat knitting machines with suction nozzles adjustably mounted on the cam carriage of the flat knitting machine and directed at the needle beds and which are connected with a suction fan driven by an electric motor and located on the cam carriage.

A dust extraction device of the kind set out in the introduction has been proposed in DE-OS No. 33 05 795.

Dust extraction devices located on the cam carriage of flat knitting machines necessarily result in an increase in the weight of the cam carriage. In order to maintain this increase in weight within limits, one must endeavour to construct the dust extraction device to be as compact and low in mass as possible. On the other hand, a sufficient dust extraction effect must remain ensured. Arising out of this problem, the aim constituting the basis of the invention, is to construct a dust extraction device of the kind set out in the introduction so that it results in a high degree of effectiveness with a favourable performance weight and can be operated in a manner which is as maintenance-fre and energy-saving as possible.

The problem set forth is solved, according to the invention, in a dust extraction device of the kind set out in the introduction in that separate and individually switchable and controllable suction fans are provided for the front and rear needle beds and suction nozzles connected with them are lowered into the stitch-forming region of the needle heads.

The use of two separately controllable and switchable suction fans has the advantage that in place of a voluminous and thus unwieldy dust extraction device, two smaller suction fans can be used, which are more easily accomated on the cam carriage. If on a double bed flat knitting machine operations are carried out only or predominantly on one needle bed, dust extraction can be restricted, by means of the dust extraction device constructed according to the invention, to the front needle bed, without the need for closure devices for a part of the suction ducting, and the energy use for dust removal on the front and rear needle beds can be rationally adjusted to the varying degrees of use by varying operating intervals.

The energy requirement necessary for extraction of fluff is very much reduced with the dust extraction device constructed according to the invention by lowering the suction nozzles into the stitch-forming region of the needle heads, and, advantageously, the suction nozzles can have, on both sides facing the direction of cam carriage movement, side, cut-away openings, which create room for the needle heads, which are passed over and subjected to the suction effect, to retract, and for execution of the knock-over of the needle latches. Due to the reduced expenditure of energy, smaller and less powerfull and thus also lighter suction fans can be used so that the energy saving can be still further reduced by the construction of the suction fans and the suction ducts leading from the suction nozzles to the suction fans. With this in view, the suction ducts can suitably comprise tubes with a circular cross-section, which have a very smooth and also, advantageously, an anti-static inner surface, so that a low resistance to movement of fluff and dust into the dust containers of the suction fans is ensured.

Advantageously, the suction fans can be so constructed that the suction ducts, which lead from the suction nozzles to the associated suction fans, open into the region near the upper end face of a vertically arranged, cylindrical dust container whose upper end face has a central, filter-covered opening over which the suction fan is located. This arrangement, in conjunction with a fan wheel for the suction fan having an axial air intake and a tangential air discharge, results in a good dust extraction in the dust container and reduces the danger of an obstruction of the filter opening leading to the fan wheel of the suction fan, which is important for maintaining a high pressure reduction at the suction nozzles and which maintains the servicing expenditure for the dust extraction device at a low value. Due to the cyclone-like whirling motion, the dust which is sucked in is massed together and, because of the concentration, falls more quickly to the floor. The suitably cylindrical dust container can be constructed with a relatively small volume without shortening the intervals between emptying operations. A dust extraction device according to the invention can thus be constructed in a relatively small and compact form with short suction ducts and can be located at the side of the cam carriage above the device for driving the cam carriage, whilst the two suction fans are suitably arranged one behind the other in the direction of movement of the cam carriage and have oppositely rotating rotors. Due to the opposite rotation of the rotors, the torque loading of the cam carriage is to a large extent mutually cancelled by simultaneous operation of the two suction fans, with the result that the construction for mounting the dust extraction device can be made lighter.

An embodiment of a dust extraction device constructed according to the invention will be described in greater detail below with reference to the accompanying drawings.

Figure 2:
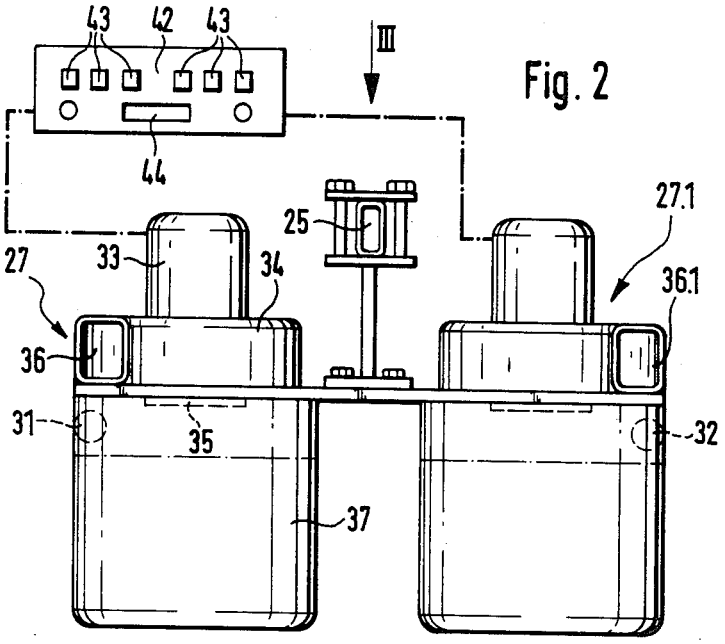
Figure 3:
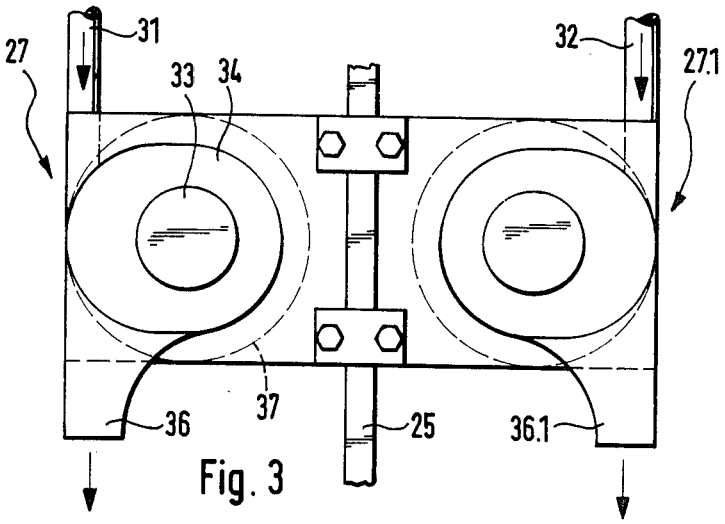
Figure 4:
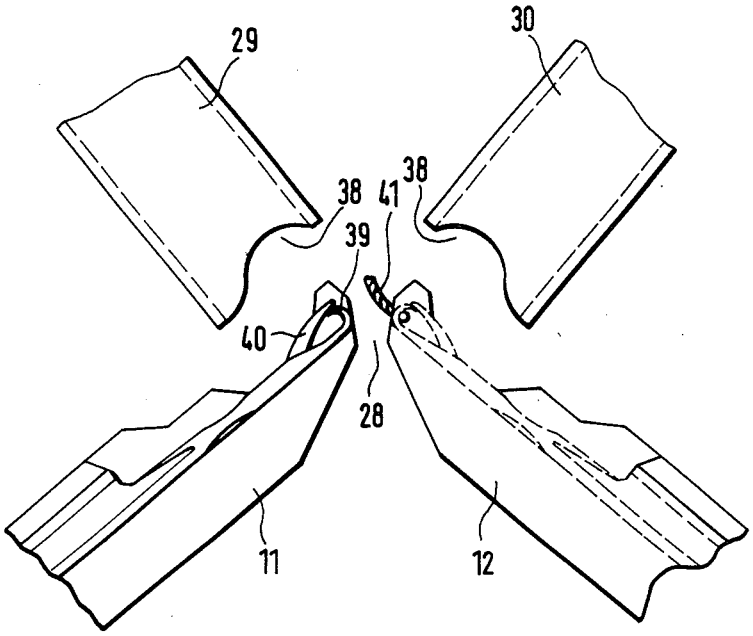

In detail there is shown in,

FIG. 1 a very schematic end view of a flat knitting machine with two needle beds;

FIG. 2 a detail of the suction fan part of the dust extraction device of the flat knitting machine in a side view in the direction of the arrow II in FIG. 1;

FIG. 3 a plan view of the suction fan arrangement in the direction of the arrow III in FIG. 2;

FIG. 4 a partial cross-section through the two needle beds in the knitting region with the suction nozzles of the dust extraction device which are located there.

The schematic end view of FIG. 1 shows the machine frame 10 of a flat knitting machine, the two needle beds 11 and 12, the cam carriage 13 with its two cam plates 15 and 16 connected with one another by bows 14, three yarn feeder rails 17 overspanned by the bows 14, a bobbin table 18, a drive motor 19 for driving the cam carriage 14 by means of drive belts 20 and 21 through intermediate axles 22 and 23 as well as parts of the cam carriage drive device 24. From the bows 14 of the cam carriage to the rear side of the flat knitting machine there extends, in the region between the bobbin table 18 and the cam carriage driving device 24, a support beam 25. The supply of current to the cam carriage 13 is effected from a cable supply device 26 over this support beam 25, and on this support beam 25, also, are secured suction fans 27 of a dust extraction device of the cam carriage 13, which have front and rear suction nozzles 29 and 30, extending into the knitting region 28, which are connected with the suction fan part of the dust extraction device through round rubes 31 and 32 with smooth inner surfaces.

As shown in FIGS. 2 and 3, the dust extraction device secured on the cam carriage 13 of the flat knitting machine has two suction fans 27 and 27.1 arranged one behind the other in the direction of movement of the cam carriage and of identical construction. Their electric drive motor 33 is arranged with its axis vertical and drives a fan wheel located in a snail-shaped housing 34. The two suction fans 27 and 27.1 are arranged so that their rotors with the propellor wheels, not shown, have opposed rotations. The propellor wheels suck in the air in each case through a filter-covered opening 35 in an axial direction and forward the air sucked in, through a tangential duct 36 or 36.1, to the atmosphere at the rear of the flat knitting machine. Beneath each of the suction fans 27 and 27.1 is a removable, closed dust container 37 in whose upper wall is located the filter-covered opening 35 serving as the suction opening of the suction fan 27. Further, there opens into its upper region in a tangential direction the suction duct 31 or 32 from the suction nozzles 29 or 30 and which is constructed from a round tube having on its inner surface a very smooth, anti-static coating. The suction ducts 31 and 32 can be branched to extend, in a manner not shown, to a number of suction nozzles 29 and 30.

As shown in FIG. 4, the suction nozzles 29 and 30 are, as far as possible, led to the region of stitch formation above the bed gap between the two needle beds 11 and 12. They are provided at the nozzle end with side cut-away openings 38 which provide free space for the needle heads 39 with their needle latches 40, over which the suction nozzles are moved by the movement of the cam carriage, to take up the yarn 41 to be knitted and for the knock-over of the needle latches.

In FIG. 2 is shown the control panel 42 of a control device for the dust extraction device, by means of which an intermittent operation of the suction fans 27 and 27.1 independently of one another and with adjustable time periods, can be instituted. The suction periods and the intervals between them can be chosen by means of keys 43 in dependence upon the yarn used and the nature of the knitting formed and can be made apparent on a display device 44.

We claim:

1. A dust extraction device for flat knitting machines, with suction nozzles adjustably mounted on the cam carriage of the flat knitting machine and directed at the needle beds and which are connected with a suction fan driven by an electric motor and mounted on the cam carriage, characterised in that seperate and individually switchable and controllable suction fans (27,27.1) are provided for the front and rear needle beds (11,12) and suction nozzles, which are connected with them, are lowered into the stitch-forming region (28) of the needle heads (39).

2. A dust extraction device according to claim 1, characterised in that the suction nozzles (29,30) have on both sides facing the direction of cam carriage movement, side cut-away openings (38), which create room for the needle heads passed over to descend and for the execution of the knock-over of the needle latches.

3. A dust extraction device according to claim 1, characterised in that the suction ducts (31,32) leading from the suction nozzles (29,30) to the associated suction fans (27,27.1) open tangentially into the upper region of a vertically arranged, cylindrical dust collector (37) whose upper face has a central, filter-covered opening (35) above which the suction fan (27,27.1) is located.

4. A dust extraction device according to claim 1, characterised in that the two suction fans (27,27.1) are arranged one behind the other in the direction of movement of the cam carriage (13) and their rotors rotate in opposite directions.

5. A dust extraction device according to claim 1, characterised in that the suction ducts (31,32) leading from the suction nozzles (29,30) to the dust containers of the suction fans (27,27.1) comprise tubes with a circular cross-section which have a very smooth inner surface.

6. A dust extraction device according to claim 5, characterised in that the very smooth inner surface is formed by a coating with an electrically anti-static effect.

7. A dust extraction device according to claim 1, characterised in that the two suction fans (27,27.1) are connected to a control device (42), which has adjustable time periods for automatic, independent switching of the suction fans at intervals.

8. A dust extraction device according to claim 1, characterised in that the rotor of each suction fan (27,27.1) is formed as a fan wheel for axial intake and tangential discharge of air.

9. A dust extraction device according to claim 1, characterised in that the suction fans (27,27.1) are located on the cam carriage (13) at the side and above the position at which it is coupled to the device for driving the cam carriage.

* * * * *